US009601859B2

(12) United States Patent
Nagasaki et al.

(10) Patent No.: US 9,601,859 B2
(45) Date of Patent: Mar. 21, 2017

(54) TERMINAL FITTING

(71) Applicant: Sumitomo Wiring Systems, Ltd., Yokkaichi, Mie (JP)

(72) Inventors: Takashi Nagasaki, Mie (JP); Shohei Nagasaki, Mie (JP); Hiroshi Hamada, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/032,186

(22) PCT Filed: Nov. 6, 2014

(86) PCT No.: PCT/JP2014/079413

§ 371 (c)(1),
(2) Date: Apr. 26, 2016

(87) PCT Pub. No.: WO2015/072386

PCT Pub. Date: May 21, 2015

(65) Prior Publication Data

US 2016/0268718 A1 Sep. 15, 2016

(30) Foreign Application Priority Data

Nov. 13, 2013 (JP) ..... 2013-234849
Sep. 11, 2014 (JP) ..... 2014-184924

(51) Int. Cl.
*H01R 13/428* (2006.01)
*H01R 4/18* (2006.01)
(Continued)

(52) U.S. Cl.
CPC ..... *H01R 13/428* (2013.01); *H01R 4/185* (2013.01); *H01R 13/113* (2013.01);
(Continued)

(58) Field of Classification Search
CPC ..... H01R 4/185; H01R 4/58; H01R 13/113; H01R 13/114; H01R 13/428; H01R 13/5208; H01R 13/432
(Continued)

(56) References Cited

U.S. PATENT DOCUMENTS 6,089,928 A 7/2000 Miwa et al.
6,589,083 B2 * 7/2003 Kobayashi ..... H01R 13/4362 439/595
(Continued)

FOREIGN PATENT DOCUMENTS

JP 11-283688 10/1999
JP 2002-198116 7/2002
(Continued)

OTHER PUBLICATIONS

International Search Report.

*Primary Examiner* — Edwin A. Leon
(74) *Attorney, Agent, or Firm* — Gerald E. Hespos; Michael J. Porco; Matthew T. Hespos

(57) ABSTRACT

A terminal fitting (20) has a main body (30) with a bottom wall (31), first and second facing walls (32, 33) extending from opposite sides of the bottom wall (31), an inner ceiling wall (34) extending from an extending end (33A) of the first facing wall (33) toward the second facing wall (32) and an outer ceiling wall (35) extending from an extending end (32A) of the second facing wall (33) toward the second facing wall (33) along an outer surface (34A) of the inner ceiling wall (34). A stabilizer (36) is formed by folding a projecting piece (37) standing up from the outer ceiling wall (35) toward the extending end (33A) of the first facing wall (33). A tip (37D) of the projecting piece (37) can contact the first facing wall (33) and the inner ceiling wall (34) in a recess (38) formed on a corner therebetween.

8 Claims, 14 Drawing Sheets

(51) Int. Cl.
*H01R 13/432* (2006.01)
*H01R 13/11* (2006.01)
*H01R 13/52* (2006.01)

(52) U.S. Cl.
CPC ..... *H01R 13/432* (2013.01); *H01R 13/114* (2013.01); *H01R 13/5208* (2013.01)

(58) Field of Classification Search
USPC ..... 439/842–843, 852, 862, 889, 884, 587, 439/589, 595, 752
See application file for complete search history.

(56) References Cited

U.S. PATENT DOCUMENTS

| | | | | |
|---|---|---|---|---|
| 6,939,171 | B2 * | 9/2005 | Fukatsu ..... | H01R 13/4223 439/595 |
| 7,572,142 | B2 * | 8/2009 | Katsuma ..... | H01R 13/4367 439/352 |
| 2002/0081828 | A1 | 6/2002 | Tanaka | |
| 2009/0117773 | A1 | 5/2009 | Shimizu | |
| 2011/0250805 | A1 | 10/2011 | Nishide | |

FOREIGN PATENT DOCUMENTS

| | | |
|---|---|---|
| JP | 2003-68385 | 3/2003 |
| JP | 2009-117244 | 5/2009 |
| JP | 2011-222213 | 11/2011 |

* cited by examiner

TERMINAL FITTING

BACKGROUND

1. Field of the Invention

The present invention relates to a terminal fitting in which a projection is formed to project on a main body portion in the form of a rectangular tube.

2. Description of the Related Art

Japanese Unexamined Patent Publication No. 2009-117244 discloses a terminal fitting with a rectangular tubular main body and a projection that projects out from the main body. The rectangular tubular main body extends in a front-back direction and a stabilizer (hereinafter, referred to as a "projection") is formed to protrude on an outer surface of this main body. This projection is cantilevered from a first side of a ceiling wall of the main body that extends along the front-back direction and projects toward an opposite second side of the ceiling wall. Further, a locking portion is provided on an extending end part of the projection and a locked portion that is lockable to the locking portion in the front-back direction is provided on the second end edge of the ceiling wall. In this way, a movement of the extending end part of the projection in the front-back direction is regulated by the locking of the locking portion and the locked portion.

However, the above-described projection may be buckled, deformed or the like when a force acts from the second side toward the first side of the ceiling wall. Further, if a force acts on the projection from above, the projection may be opened, deformed or the like. A case where the terminal fitting receives a reaction force from a rubber plug when the terminal fitting is inserted into a hole of the rubber plug is cited as an example in which such a force acts on the projection.

The present invention was completed based on the above situation and aims to prevent the deformation of a projection.

SUMMARY

The present invention is directed to a terminal fitting with a main body in the form of a rectangular tube, and a projection formed to project on the main body. The main body includes a bottom wall, first and second facing walls extending from opposite side edges of the bottom wall while facing each other, an inner ceiling wall extending from an extending end of the first facing wall toward the second facing wall and an outer ceiling wall extending from an extending end of the second facing wall toward the first facing wall along an outer surface of the inner ceiling wall. The projection is formed into a cantilever shape by folding a projecting piece standing up from the outer ceiling wall in a direction away from the inner ceiling wall toward the extending end of the first facing wall, and a tip part of the projecting piece is capable of contacting both the first facing wall and the inner ceiling wall in a recess formed on a corner part coupling the first facing wall and the inner ceiling wall by arranging the tip part of the projecting piece in the recess.

According to this configuration, the tip part of the projecting piece constituting the projection is capable of contacting the inner ceiling wall in the recess. Thus, the deformation of the projection can be prevented even if a force acts from the extending end of the first facing wall toward the extending end of the second facing wall.

A contact surface of the inner ceiling wall to be held in contact with the tip part of the projecting piece may be formed over an entire area of the inner ceiling wall in a plate thickness direction. Thus, the deformation of the projection can be prevented reliably since the tip part of the projecting piece comes into contact with the entire area of the inner ceiling wall in the plate thickness direction.

The projection may include a vertical wall flush with the first facing wall. According to this configuration, a structure easy to receive the projection is realized since the vertical wall comes into flush contact with the first facing wall A contact surface of the first facing wall to be held in contact with the vertical wall may be formed over an entire area of the first facing wall in a plate thickness direction. According to this configuration, the projection can be received strongly since the vertical wall comes into contact with the entire area of the first facing wall in the plate thickness direction.

A chamfered portion may be formed on a contact edge of the projection to be held in contact with a rubber plug when the main body is inserted into a hole of the rubber plug. According to this configuration, the chamfered portion comes into contact with the rubber plug and the damage of the rubber plug by the projection can be prevented when the main body is inserted into the hole of the rubber plug.

The projection may include a holding portion for holding the tip part of the projecting piece in a state arranged in the recess. According to this configuration, there is no possibility that the tip part of the projecting piece sticks out from the recess and a resin part such as a retainer is damaged when the tip part passes over the resin part.

The holding portion may include a holding protrusion lockable to the outer ceiling wall from the side of the inner ceiling wall. According to this configuration, the tip part of the projecting piece can be held in a state arranged in the recess by locking the holding protrusion to the outer ceiling wall.

The projection may include a cut portion formed by cutting off a part of a front edge of the projecting piece and the holding protrusion may be formed between the cut portion and the tip of the projecting piece. According to this configuration, the holding protrusion can be locked to the outer ceiling wall by accommodating an end part of the outer ceiling wall in the cut portion.

According to the present invention, it is possible to prevent the deformation of a projection.

DETAILED DESCRIPTION

Figure 1:
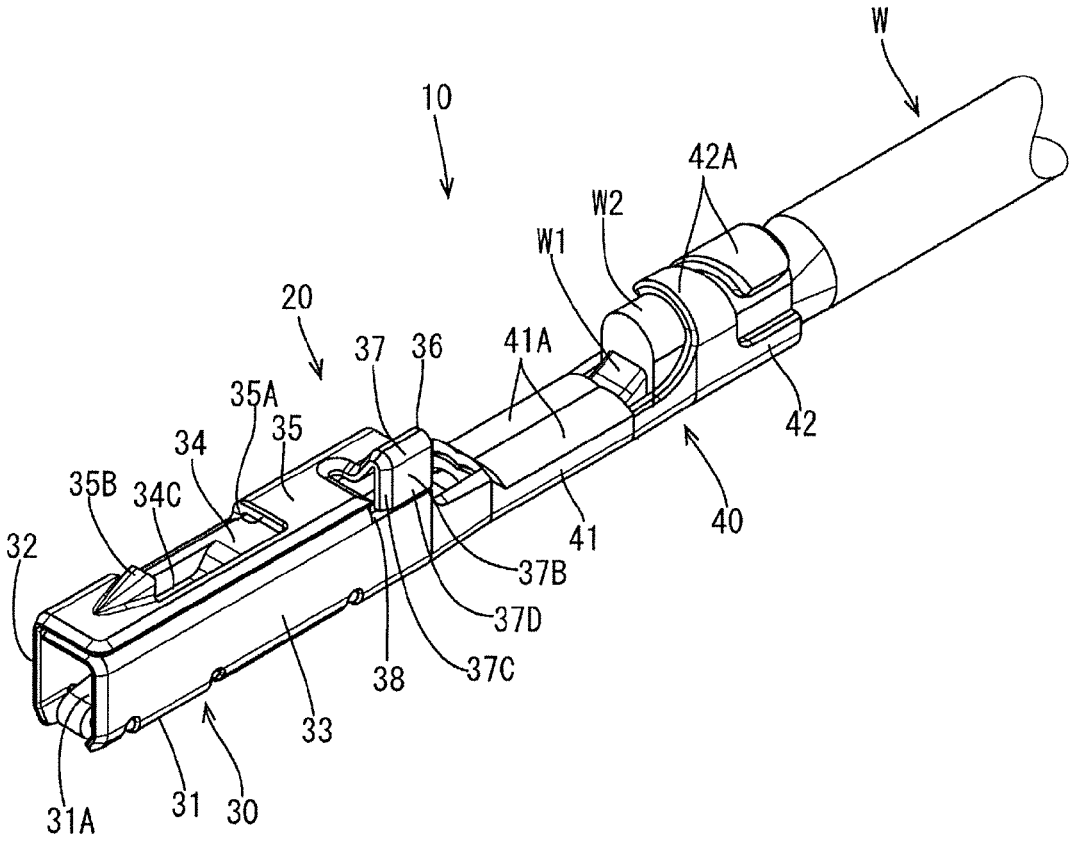
FIG. 1 is a perspective view of a wire with terminal fitting of a first embodiment.
Figure 2:
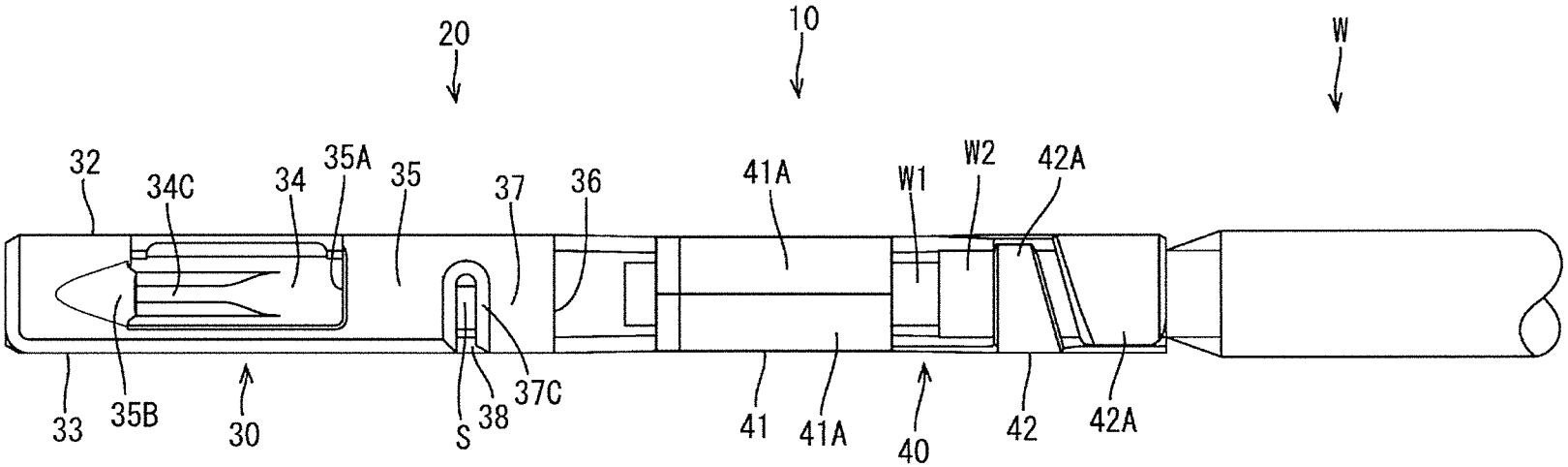
FIG. 2 is a plan view of the wire with terminal fitting.
Figure 3:
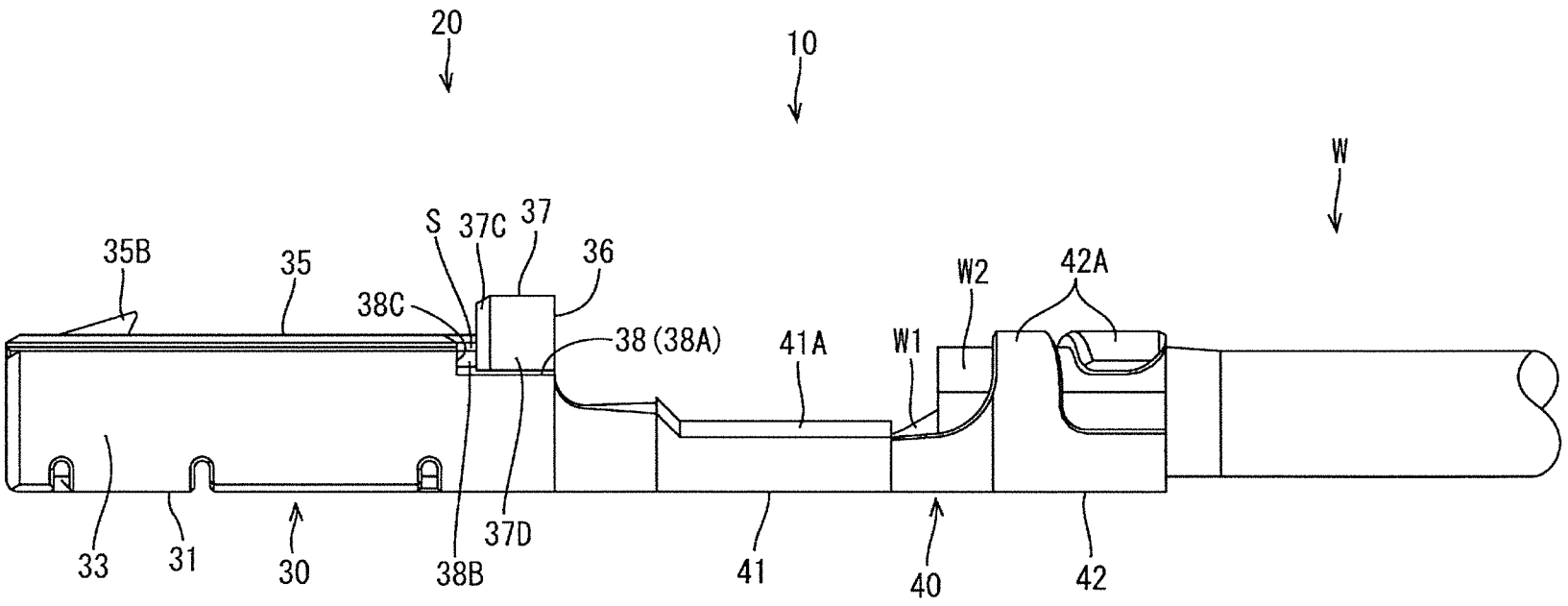
FIG. 3 is a side view of the wire with terminal fitting.
Figure 4:
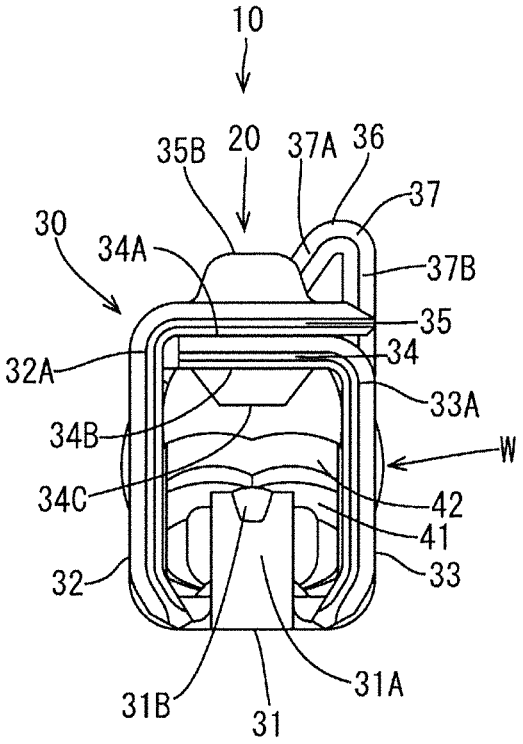
FIG. 4 is a front view of the wire with terminal fitting.

A first embodiment of the present invention is described with reference to FIGS. 1 to 10. A wire with terminal fitting 10 in this embodiment includes a wire W and a terminal fitting 20 connected to an end of this wire W as shown in FIG. 1. The wire W is composed of a core W1 formed by bundling a plurality of metal strands and an insulation coating W2 covering this core W1. The terminal fitting 20 includes a main body 30 having a rectangular tube shape and extending in a front-back direction and a barrel portion 40 arranged behind this main body 30.

The barrel portion 40 includes a wire barrel 41 to be crimped to the core W1 and an insulation barrel 42 to be crimped to the insulation coating W2. The wire barrel 41 includes a pair of wire barrel pieces 41A and these wire barrel pieces 41A are crimped so that tip parts thereof bite into the core W1. On the other hand, the insulation barrel 42 includes a pair of insulation barrel pieces 42A and these insulation barrel pieces 42A are crimped so as to wrap around the insulation coating W2 from opposite sides.

The main body 30 includes a bottom wall 31, a pair of facing walls 32, 33 extending from opposite side edges of this bottom wall 31 while facing each other, an inner ceiling wall 34 extending from an extending end 33A of the left facing wall (facing wall located on the left side when viewed from behind the main body 30, corresponding to "a first facing wall" of the present invention) 33 toward the right facing wall (facing wall located on the right side when viewed from behind the main body portion 30, corresponding to "a second facing wall" of the present invention) 32 and an outer ceiling wall 35 extending from an extending end 32A of the right facing wall 32 toward the left facing wall 33 along an outer surface 34A of the inner ceiling wall 34.

Figure 8:
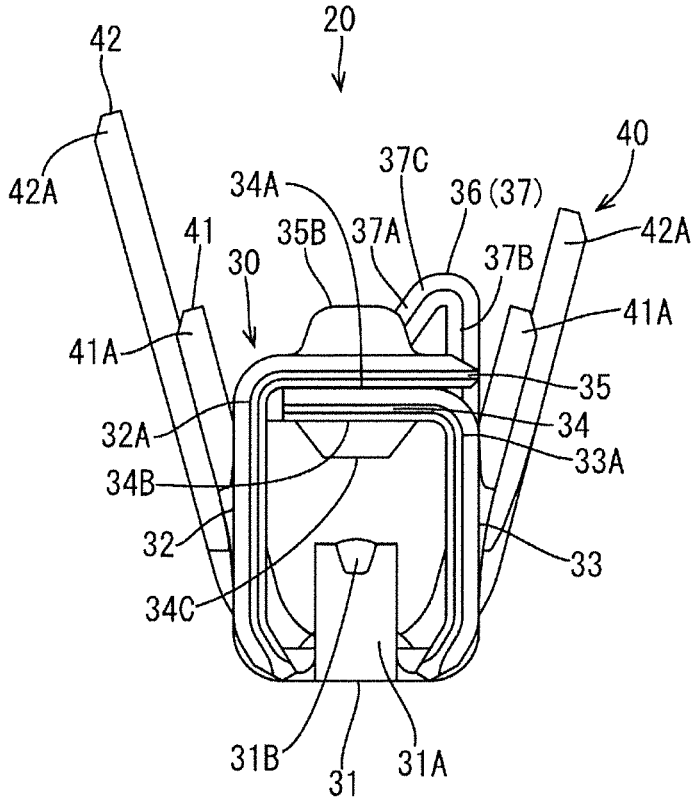
FIG. 8 is a front view of the terminal fitting.
Figure 9:
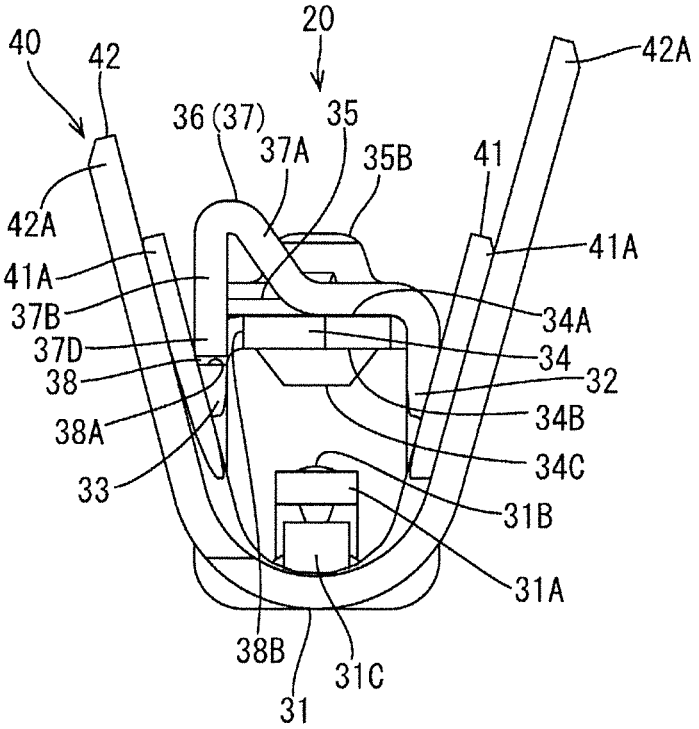
FIG. 9 is a rear view of the terminal fitting.

As shown in FIG. 8, a resilient contact piece 31A extends back from the front edge of the bottom wall 31 into the main body 30. The upper surface of the resilient contact piece 31A is struck to form a contact portion 31B projecting up. On the other hand, an inner surface 34B of the inner ceiling wall 34 is struck to form a receiving portion 34C projecting down. When an unillustrated tab terminal is fit into the main body 30 from the front, the resilient contact piece 31A is deflected and deformed down by being pressed by the tab terminal and the tab terminal is sandwiched between the contact portion 31B and the receiving portion 34C so that the tab terminal and the terminal fitting 20 are connected electrically conductively. Note that, as shown in FIG. 9, an auxiliary spring 31C is provided below the resilient contact piece 31A to reinforce the spring elasticity of the resilient contact piece 31A.

Figure 6:
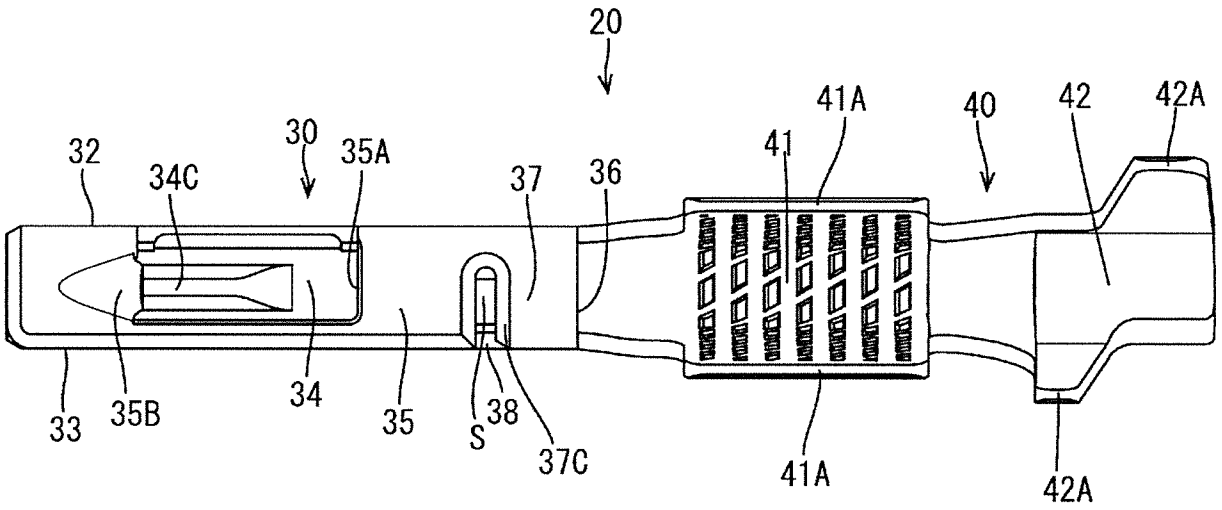
FIG. 6 is a plan view of a terminal fitting.
Figure 7:
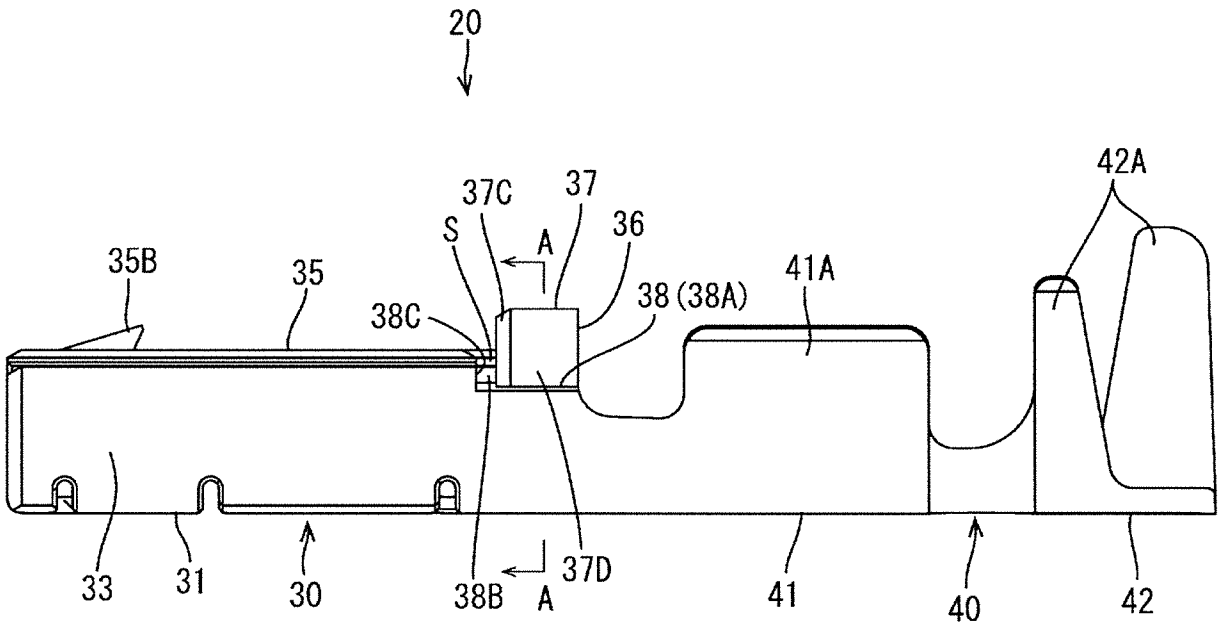
FIG. 7 is a side view of the terminal fitting.

As shown in FIG. 6, a part of the outer ceiling wall 35 is cut off to form a cut portion 35A for exposing the outer surface 34A of the inner ceiling wall 34, and a part of the receiving portion 34C is exposed to outside in this cut portion 35A. Further, a rearwardly open V-shaped locking portion 35B is formed on the front edge of the cut portion 35A. As shown in FIG. 7, this locking portion 35B is formed to become higher toward the back, and the rear end opening edge thereof is undercut. An unillustrated locking lance is locked to the locking portion 35B from behind so that the terminal fitting 20 is held in a housing.

Figure 10:
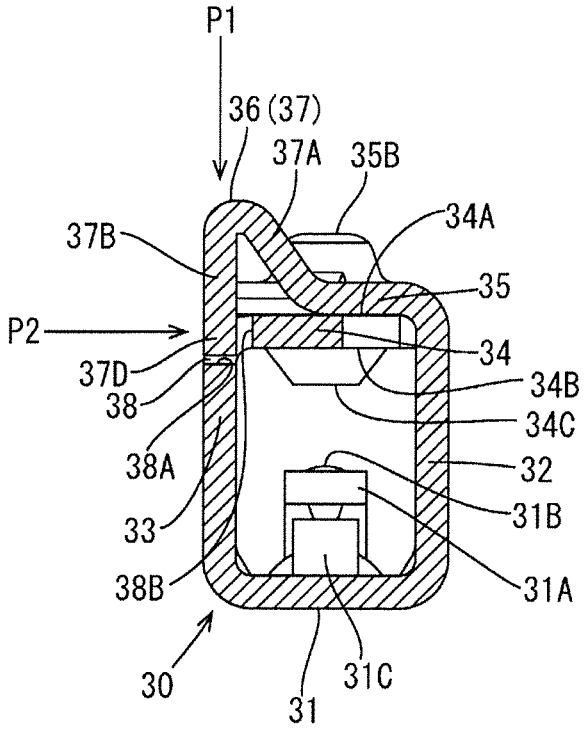
FIG. 10 is a section along A-A of FIG. 7.

A stabilizer (an example of a "projection" of the present invention) 36 is formed on a rear end part of the upper surface of the main body 30. As shown in FIG. 6, this stabilizer 36 is formed by bending a projecting piece 37 separated by forming a slit S on the outer ceiling wall 35. As shown in FIG. 10, this projecting piece 37 is composed of an inclined wall 37A standing in an oblique direction from a widthwise central part of the outer ceiling wall 35 and a vertical wall 37B extending down from the upper end of this inclined wall 37A. A coupling part of the inclined wall 37A and the vertical wall 37B is rounded and that of the inclined wall 37A and the outer ceiling wall 35 also is rounded. Further, the vertical wall 37B is arranged to be flush with the left facing wall 33.

Further, as shown in FIGS. 6 to 8, a tapered chamfered portion 37C is formed on the front edge of the projecting piece 37. The front edge of the projecting piece 37 serves as a contact edge to be brought into contact with an inner wall of a hole 51 of a collective rubber plug 50 shown in FIG. 5 when the main body 30 is inserted into the hole 51 from behind. Furthermore, the chamfered portion 37C is formed continuously into a substantially U shape along the front edge of the slit S from the front edge of the projecting piece 37, as shown in FIG. 6. Thus, the chamfered portion 37C is formed entirely in a part of the stabilizer 36 projecting up from the outer surface of the main body 30 (upper surface of the outer ceiling wall 35).

As shown in FIG. 10, a recess 38 is formed on a corner part that couples the left facing wall 33 and the inner ceiling wall 34 and can receive a tip part 37D of the projecting piece 37. In other words, the recess 38 is formed from the left facing wall 33 to the inner ceiling wall 34. Specifically, the recess 38 has a contact surface 38A with which the vertical wall 37B comes into contact in a vertical direction P1 and a contact surface 38B with which the vertical wall 37B comes into contact in a horizontal direction P2.

The contact surface 38A of the left facing wall 33 is formed over an entire area of the left facing wall 33 in a plate thickness direction and the contact surface 38B of the inner ceiling wall 34 is formed over an entire area of the inner ceiling wall 34 in a plate thickness direction. By arranging the tip part 37D of the projecting piece 37 in the recess 38, the tip part 37D of the projecting piece 37 is capable of contacting both the contact surface 38A of the left facing wall 33 and the contact surface 38B of the inner ceiling wall 34. Thus, the stabilizer 36 can be prevented from being deformed by a force acting in the vertical direction P1 and also from being deformed by a force acting in the horizontal direction P2.

Figure 5:
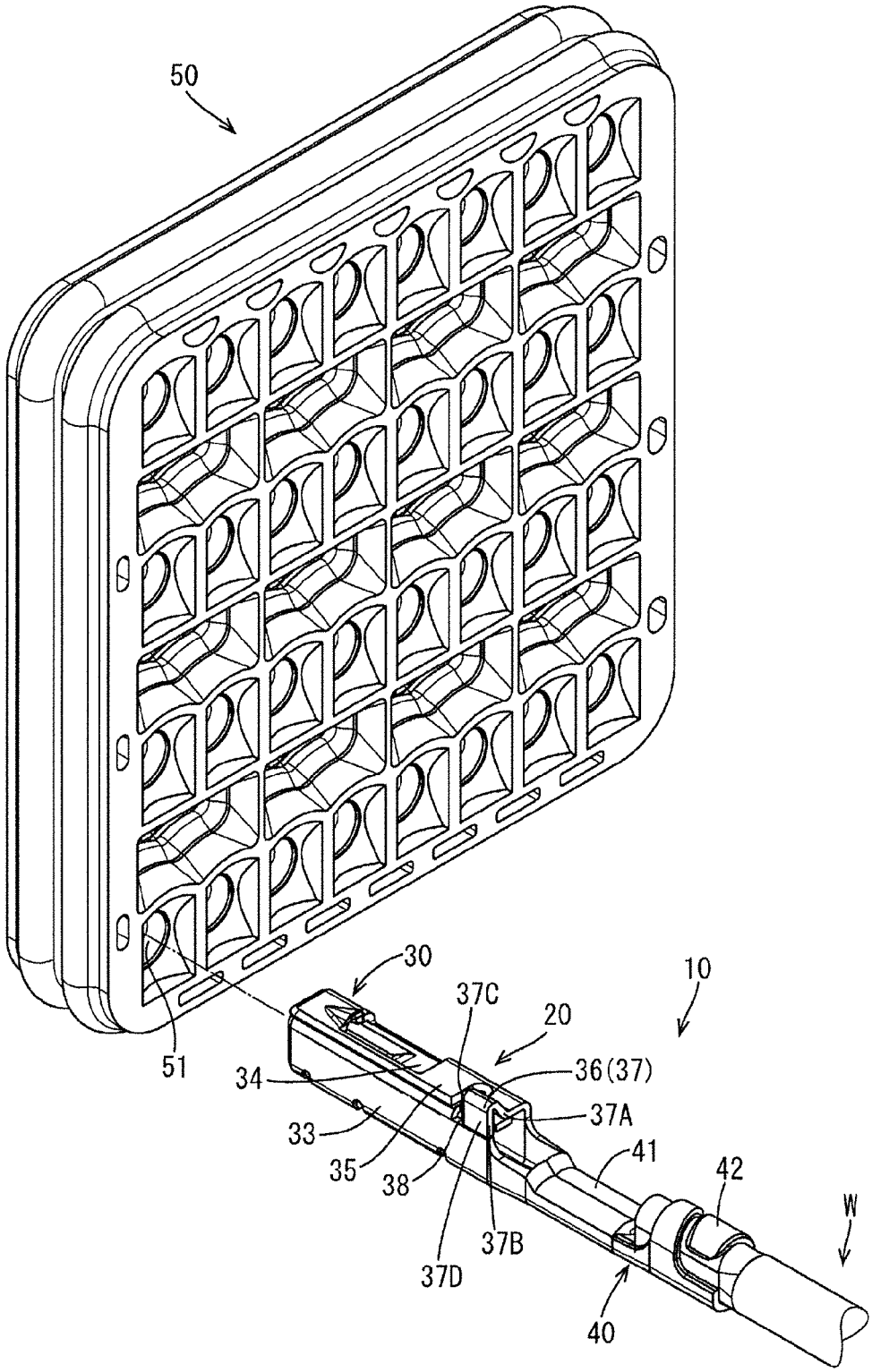
FIG. 5 is a perspective view showing a state where the wire with terminal fitting is inserted into a collective rubber plug.

This embodiment is configured as described above. Next, functions thereof are described. When the terminal fitting 10 is inserted into the hole 51 of the collective rubber plug 50 from behind, as shown in FIG. 5, the main body 30 is inserted while resiliently deforming the hole 51. At this time, the main body 30 receives a reaction force from the inner wall of the deformed hole 51. Since the stabilizer 36 further widens and deforms the hole 36 when approaching a hole edge part of the hole 51, it receives a stronger force from the inner wall of the hole 51. This reaction force acts in two directions, i.e. the vertical direction P1 and the horizontal direction P2 shown in FIG. 10. However, the reaction force acting in the vertical direction P1 is received by the contact of the tip part 37D of the projecting piece 37 with the contact surface 38A of the left facing wall 33 and the reaction force acting in the horizontal direction P2 is received by the contact of the tip part 37D of the projecting piece 37 with the contact surface 38B of the inner ceiling wall 34. Thus, the stabilizer 36 is not deformed. Further, the chamfered portion 37C prevents damage of the collective rubber plug 50.

As described above, in this embodiment, the tip part 37D of the projecting piece 37 constituting the stabilizer 36 can come into contact with the inner ceiling wall 34 in the recess 38. Therefore the deformation of the stabilizer 36 can be prevented even if a force acts from the extending end 33A of the first facing wall (left facing wall 33) toward the extending end 32A of the second facing wall (right facing wall 32).

The contact surface 38B of the inner ceiling wall 34 to be held in contact with the tip part 37D of the projecting piece 37 may be formed over the entire area of the inner ceiling wall 34 in the plate thickness direction. According to this configuration, the tip part 37D of the projecting piece 37 comes into contact with the entire area of the inner ceiling wall 34 in the plate thickness direction. Therefore the deformation of the stabilizer 36 can be prevented reliably.

The stabilizer 36 may include the vertical wall 37B flush with the first facing wall (left facing wall 33). According to this configuration, the vertical wall 37B comes into flush contact with the first facing wall (left facing wall 33) to provide a structure that can easily receive the stabilizer 36.

The contact surface 38A of the first facing wall (left facing wall 33) to be held in contact with the vertical wall 37B may be formed over the entire area of the first facing wall (left facing wall 33) in the plate thickness direction. According to this configuration, the stabilizer 36 can be received strongly since the vertical wall 37B is held in contact with the entire area of the first facing wall (left facing wall 33) in the plate thickness direction.

The chamfered portion 37C may be formed on the front contact edge of the stabilizer 36 to be brought into contact with the collective rubber plug 50 when the main body 30 is inserted into the hole 51 of the collective rubber plug 50. According to this configuration, the chamfered portion 37C comes into contact with the collective rubber plug 50 when the main body 30 is inserted into the hole 51 of the collective rubber plug 50, thereby preventing damage of the collective rubber plug 50 by the stabilizer 36.

Figure 11:
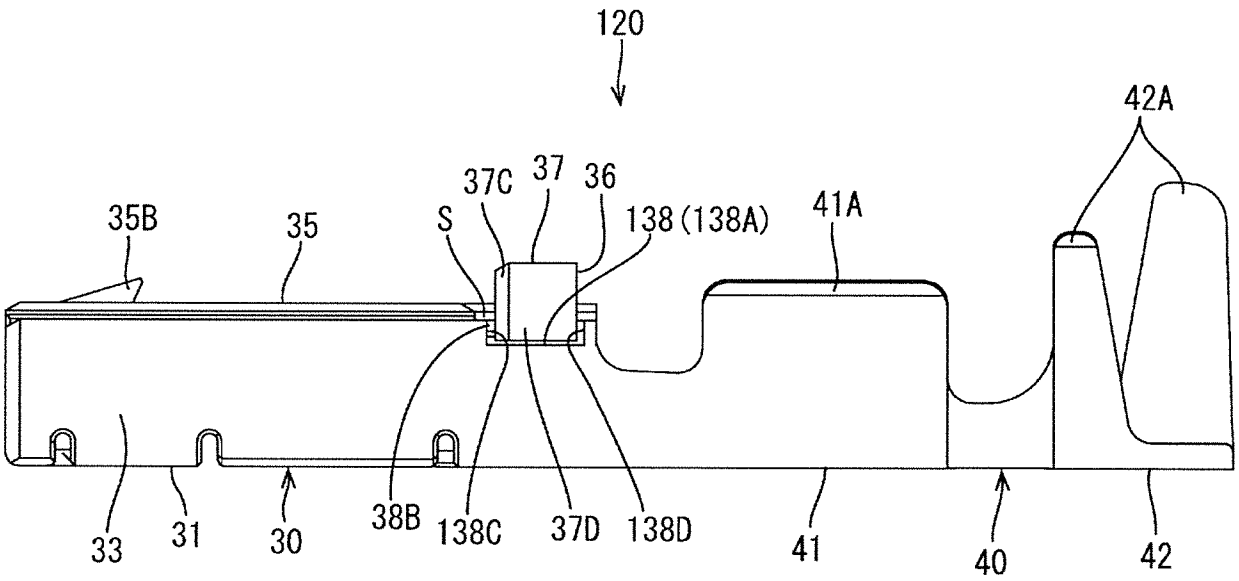
FIG. 11 is a side view of a terminal fitting of a second embodiment.

Next, a second embodiment of the present invention is described with reference to FIG. 11. In a terminal fitting 120 of this embodiment, the configuration of the recess 38 of the first embodiment is changed partly. The same components as those of the first embodiment are denoted by the same reference signs as in the first embodiment, and the configuration, functions and effects overlapping with those of the first embodiment are not described.

A contact surface 38C is formed only before the tip part 37D of the projecting piece 37 in the recess 38 of the first embodiment, whereas contact surfaces 138C, 138D are formed before and behind a tip part 37D of a projecting piece 37 in a recess 138 of this embodiment. According to this configuration, even if a stabilizer 36 receives a force from the front when the terminal fitting 120 is inserted into the hole 51 of the collective rubber plug 50, the tip part 37D of the projecting piece 37 is prevented from moving backward by the contact surface 138D arranged behind the stabilizer 36. Further, even if the stabilizer 36 receives a force from behind when the terminal fitting 120 is pulled out from the hole 51 of the collective rubber plug 50, the tip part 37D of the projecting piece 37 is prevented from moving forward by the contact surface 138D arranged before the stabilizer 36. This point holds true also for the terminal fitting 20 of the first embodiment. Thus, according to the terminal fitting 120 of this embodiment, a movement of the tip part 37D of the projecting piece 37 in the front-back direction is suppressed regardless of from which of the front and rear sides the stabilizer 36 receives a force and the deformation of the stabilizer 36 can be prevented.

Figure 12:
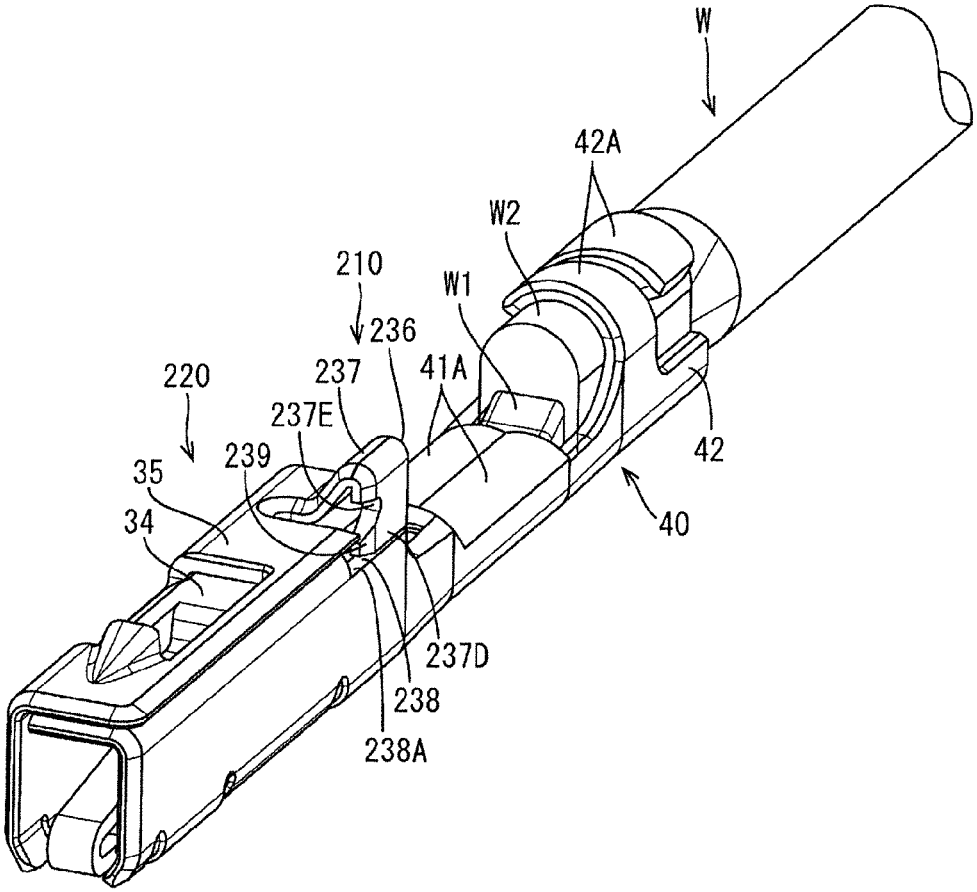
FIG. 12 is a perspective view showing a wire with terminal fitting of a third embodiment.

Next, a third embodiment of the present invention is described with reference to FIGS. 12 to 14. A wire with terminal fitting 210 of this embodiment includes a wire W and a terminal fitting 220 as shown in FIG. 12. In this terminal fitting 220, the configurations of the stabilizer 36 and the recess 38 of the first embodiment are changed partly. The same components as those of the first embodiment are denoted by the same reference signs as in the first embodiment, and the configuration, functions and effects overlapping with those of the first embodiment are not described.

A stabilizer 236 of this embodiment includes a cut portion 237E formed by cutting off a part of the front edge of a projecting piece 237, and a holding protrusion 239 is formed between this cut portion 237 and the tip of the projecting piece 237. A surface of this holding protrusion 239 facing the cut portion 237 is formed as a tapered surface that is inclined up toward the back.

On the other hand, an expanded recess 238*a* formed by cutting off a rear end part of an inner ceiling wall 34 is provided on a front side of the recess 238. This expanded recess 238A communicates with the recess 238 and the holding protrusion 239 of the stabilizer 236 is insertable therein as shown in FIG. 14.

Figure 13:
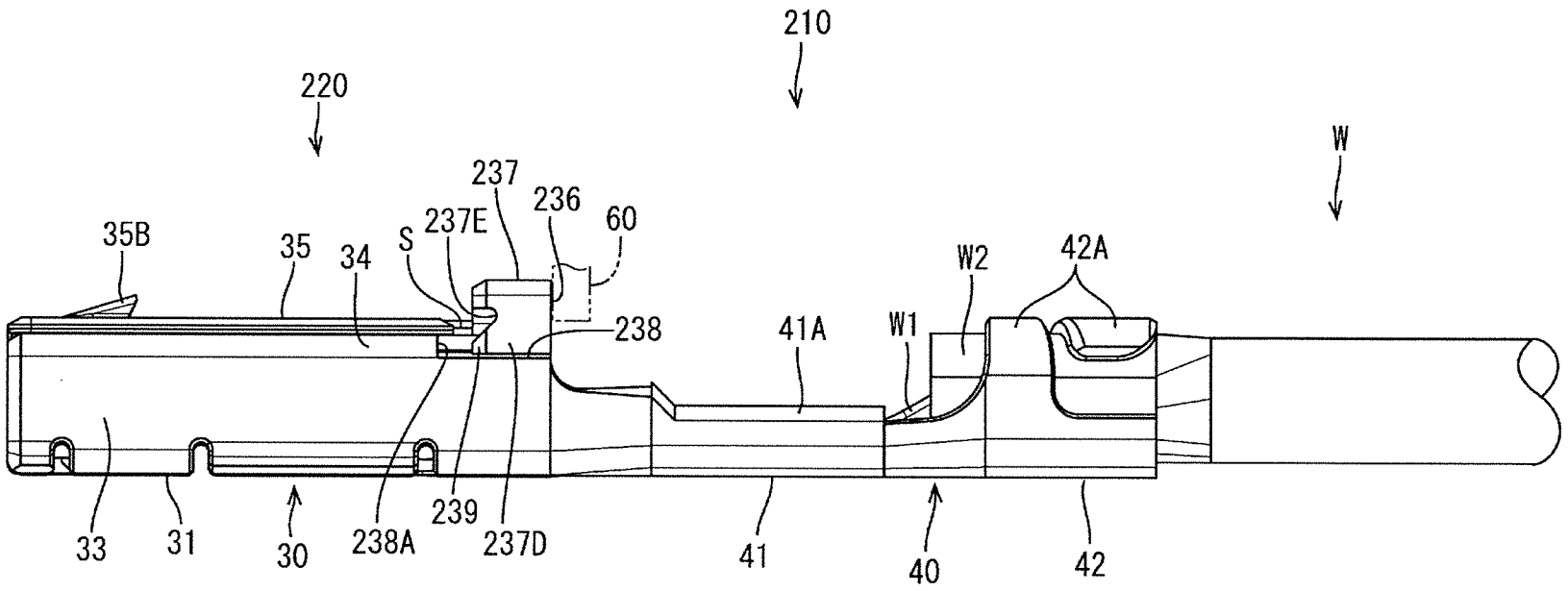
FIG. 13 is a side view of the wire with terminal fitting.
Figure 14:
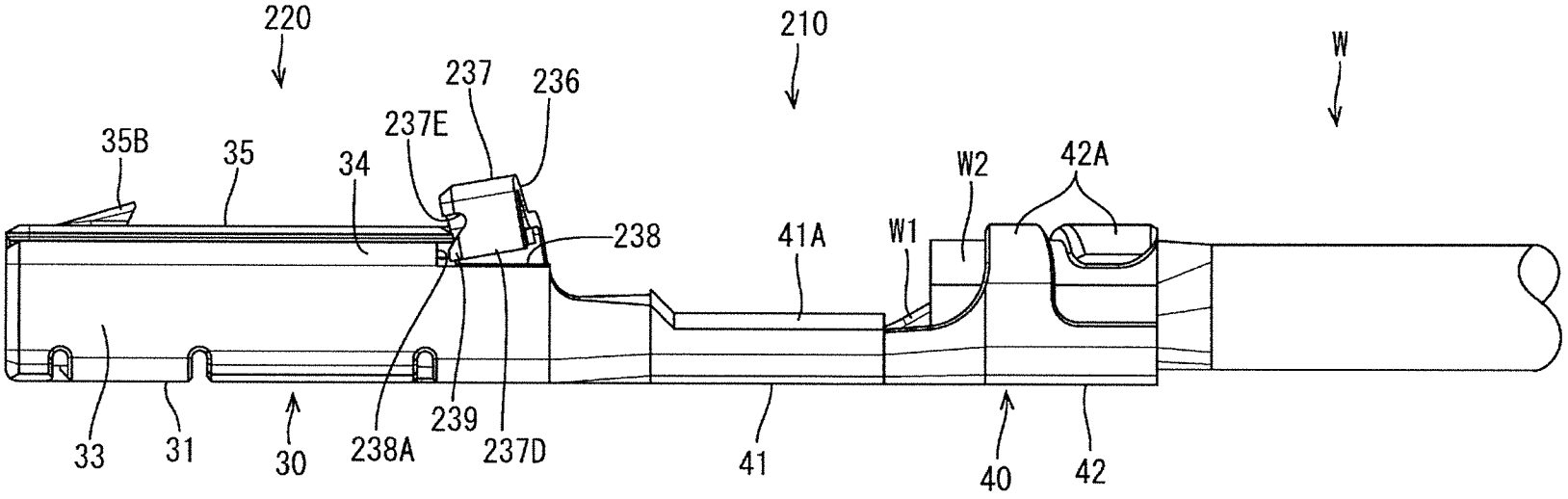
FIG. 14 is a side view showing a state where a projection is inclined forwardly.

As shown in FIG. 13, a retainer 60 is locked to the stabilizer 236 from behind and the terminal fitting 220 is held in the housing by being locked doubly by both the retainer 60 and a locking lance. However, the stabilizer 236 may be inclined forwardly by the retainer 60, such as when the wire W is pulled with a strong force. At this time, as shown in FIG. 14, the holding protrusion 239 of the stabilizer 236 enters the expanded recess 238A and the tapered surface of the holding protrusion 239 is locked to a rear end part of an outer ceiling wall 35 from below, thereby preventing the inclination of the stabilizer 236. Thus, the tip part 237D of the projecting piece 237 is held in a state arranged in the recess 238. Here, it can be avoided that a locking wall of the retainer 60 is torn by the tip part 237D of the projecting piece 237 if the stabilizer 236 slips under the retainer 60 and the terminal fitting 220 is pulled out backward.

As described above, in this third embodiment, a projection (stabilizer 236) may include a holding portion (holding protrusion 239) for holding the tip part 237D of the projecting piece 237 in a state arranged in the recess 238. According to this configuration, there is no possibility that the tip part 237D of the projecting piece 237 sticks out from the recess 238 and damages a resin part such as the retainer 60, for example, when the tip part 237D passes over the resin part.

The holding portion may include the holding protrusion 239 lockable to the outer ceiling wall 35 from the side of the inner ceiling wall 34. According to this configuration, the tip part 237D of the projecting piece 237 can be held in the state arranged in the recess 238 by locking the holding protrusion 239 to the outer ceiling wall 35.

The projection may include the cut portion 237E formed by cutting off a part of the front edge of the projecting piece 237 and the holding protrusion 239 may be formed between the cut portion 237E and the tip of the projecting piece 237. According to this configuration, the holding protrusion 239 can be locked to the outer ceiling wall 35 by accommodating an end part of the outer ceiling wall 35 in the cut portion 237E.

The invention is not limited to the above described and illustrated embodiments. For example, the following embodiments also are included in the scope of the invention.

Although the stabilizer 36 is illustrated as the projection in the first and second embodiments, a locked portion to be locked to the retainer may be the projection according to the present invention.

Although the contact surfaces 38A, 38B of the recess 38 and the contact surfaces 138A, 38B of the recess are formed over the entire areas in the plate thickness direction in the first and second embodiments, a contact surface may be formed in a partial area in the plate thickness direction according to the present invention.

Although the stabilizer 36 including the vertical wall 37B flush with the left facing wall is illustrated in the first and second embodiments, a stabilizer may be formed by providing an inclined wall instead of the vertical wall 37B according to the present invention.

Although the chamfered portion 37C is provided on the front edge of the stabilizer 36 in the first and second embodiments, no chamfered portion may be provided according to the present invention.

Although the expanded recess 238A is formed by cutting off the rear end part of the inner ceiling wall 34 and the holding protrusion 239 enters the expanded recess 238A in the third embodiment, the holding protrusion 239 may be locked to a rear end part of the outer ceiling wall from below by extending the outer ceiling wall backward.

LIST OF REFERENCE SIGNS

10 . . . wire with terminal fitting
20, 120, 220 . . . terminal fitting
30 . . . main body
31 . . . bottom wall
32 . . . right facing wall (second facing wall)
32A . . . extending end
33 . . . left facing wall (first facing wall)
33A . . . extending end
34 . . . inner ceiling wall
34A . . . outer surface
35 . . . outer ceiling wall
36, 236 . . . stabilizer (projection)
37, 237 . . . projecting piece
237E . . . cut portion
37B . . . vertical wall
37C . . . chamfered portion
37D, 237D . . . tip part
38, 138, 238 . . . recess
38A . . . contact surface
38B . . . contact surface
239 . . . holding protrusion
50 . . . collective rubber plug
51 . . . hole
38C, 138C . . . contact surface
138D . . . contact surface

The invention claimed is:

1. A terminal fitting, comprising:

a main body in the form of a rectangular tube; and a projection formed to project on the main body;

wherein:

the main body includes a bottom wall, first and second facing walls extending from opposite side edges of the bottom wall while facing each other, an inner ceiling wall extending from an extending end of the first facing wall toward the second facing wall and an outer ceiling wall extending from an extending end of the second facing wall toward the first facing wall along an outer surface of the inner ceiling wall; and the projection is formed into a cantilever shape by folding a projecting piece standing up from the outer ceiling wall in a direction away from the inner ceiling wall toward the extending end of the first facing wall, and a tip part of the projecting piece is configured for contacting both the first facing wall and the inner ceiling wall in a recess formed on a corner part of the first facing wall and the inner ceiling wall by arranging the tip part of the projecting piece in the recess.

2. The terminal fitting of claim 1, wherein a contact surface of the inner ceiling wall to be held in contact with the tip part of the projecting piece is formed over an entire area of the inner ceiling wall in a plate thickness direction.

3. The terminal fitting of claim 1, wherein the projection includes a vertical wall flush with the first facing wall.

4. The terminal fitting of claim 3, wherein a contact surface of the first facing wall to be held in contact with the vertical wall is formed over an entire area of the facing wall in a plate thickness direction.

5. The terminal fitting of claim 1, wherein a chamfered portion is formed on a contact edge of the projection to be held in contact with a rubber plug when the main body portion is inserted into a hole of the rubber plug.

6. The terminal fitting of claim 1, wherein the projection includes a holding portion for holding the tip part of the projecting piece in a state arranged in the recess.

7. The terminal fitting of claim 6, wherein the holding portion includes a holding protrusion lockable to the outer ceiling wall from the side of the inner ceiling wall.

8. The terminal fitting of claim 6, wherein the projection includes a cut portion formed by cutting off a part of a front edge of the projecting piece and the holding protrusion is formed between the cut portion and the tip of the projecting piece.

* * * * *